US005818334A

United States Patent [19]

Stanley

[11] Patent Number: 5,818,334

[45] Date of Patent: Oct. 6, 1998

[54] ADDRESSABLE DEVICES WITH INTERFACE MODULES HAVING ELECTRICALLY READABLE ADDRESSES

[75] Inventor: Lawrence G. Stanley, Templeton, Mass.

[73] Assignee: Simplex Time Recorder Company, Gardner, Mass.

[21] Appl. No.: 383,069

[22] Filed: Feb. 3, 1995

[51] Int. Cl.[6] ..... G08B 26/00

[52] U.S. Cl. ..... 340/505; 340/514; 340/506; 340/534; 340/535; 340/524; 340/825.06; 340/825.07

[58] Field of Search ..... 340/505, 506, 340/514, 524, 535, 825.06, 825.07, 825.08, 539

[56] References Cited

U.S. PATENT DOCUMENTS

| | | | |
|---|---|---|---|
| 4,293,947 | 10/1981 | Brittain | 370/89 |
| 4,590,963 | 5/1986 | Gardner et al. | 137/554 |
| 4,595,922 | 6/1986 | Cobb et al. | 340/825.49 |
| 4,658,243 | 4/1987 | Kimura et al. | 340/505 |
| 4,701,878 | 10/1987 | Gunkel et al. | 364/900 |
| 4,751,498 | 6/1988 | Shalvi et al. | 340/524 |
| 4,772,876 | 9/1988 | Laud | 340/539 |
| 4,796,025 | 1/1989 | Farley et al. | 340/825.08 |
| 4,823,118 | 4/1989 | Suzuki et al. | 340/693 |
| 4,988,977 | 1/1991 | Payne et al. | 340/524 |
| 5,117,219 | 5/1992 | Tice et al. | 340/518 |
| 5,173,683 | 12/1992 | Brighenti et al. | 340/505 |
| 5,243,340 | 9/1993 | Norman et al. | 340/953 |
| 5,357,243 | 10/1994 | Tice | 340/825.07 |

OTHER PUBLICATIONS

Engineering Product Guide, "XP95A—Ionization Smoke Monitor, Photo–electric Smoke Monitor, Temperature Monitor Isolator," Apollo Fire Detectors Limited, Hampshire, England, pp. 1–20, 1994.

*Primary Examiner*—Jeffery Hofsass
*Assistant Examiner*—Daryl Pope
*Attorney, Agent, or Firm*—Hamilton, Brook, Smith & Reynolds, P.C.

[57] ABSTRACT

In a communication system such as a fire detection system, individual addressable devices determine their addresses from address interface modules at the device locations. An interface module includes wire connectors for receiving system wires and a device connector. The interface module also includes jumper wires which serve as a readable address identifier adapted to be programmed to an address with installation of the module and to be subsequently read by the addressable device.

19 Claims, 4 Drawing Sheets

ADDRESSABLE DEVICES WITH INTERFACE MODULES HAVING ELECTRICALLY READABLE ADDRESSES

BACKGROUND

A common form of communication network relies on a single set of system lines extending from a controller to a number of addressable devices. For example, such networks are used in fire detection systems where the addressable devices may be smoke detectors, heat detectors and alarm indicators. Since the various devices are connected to common system lines, each has its own digital address which distinguishes it from other devices and to which it responds when the controller presents that address on the system lines.

Many approaches are used for establishing the individual addresses of the addressable devices. For example, the addresses may be established electronically during an initialization process. Alternatively, the address may be set manually by the individual who installs the device. For example, a dual-in-line package (DIP) switch may be provided on the device or, as presented in U.S. Pat. No. 5,173,683 to Brighenti et al., in its mounting base. The electronics of the device are able to read the binary state of several switches in a DIP switch and read that state as the device address. In another approach presented in U.S. Pat. No. 4,988,977 to Payne et al., the address of a fire detector is set by mechanical elements on a card in the base, and those elements actuate switches in the detector when the detector is installed on the mounting base. An advantage of the approaches which associate an address with the mounting base is that, when the detector is removed for cleaning or fails and must be replaced, the prior address is retained. This simplifies the detector replacement procedure and avoids possible error in setting the address during replacement.

SUMMARY OF THE INVENTION

In accordance with the present invention, a more reliable mechanism for establishing the addresses of addressable devices is provided. The addressable device is connected to the system lines through an address interface module. The module includes a system connector such as individual wire connectors for connecting to the system lines. An electrically readable address identifier provided on the module is adapted to be programmed to an address during installation of the module. The module is sufficiently small that it can be wired and suspended in a conventional electrical box. The preferred address identifier is simply a set of conductors which can be selectively clipped by an electrician during installation of the module. Alternative identifiers include digital switches or DIP switches. The module is connected to the addressable device through complementary device connectors, on the module and device, to provide device access to both the address identifier and to the system lines. In one embodiment of the invention, the device connectors are printed circuit connectors.

In practicing the present invention in its preferred form, an address may be programmed into the address identifier of the interface module and the interface module may be wired into the system and left in an electrical box by an electrician. It is preferred that the module be wired and programmed during initial wiring of a building, but either the wiring or programming may be delayed. In either case, the electrician need not be concerned with the particular addressable device and its mounting base when he sets the address. Subsequently, after finishing of any wall or ceiling surface to which the detector is to be mounted, a mounting base is fixed over the electrical box. The addressable device is electrically connected to the interface module to provide access to the readable address identifier and to the system lines, and the addressable device is thereafter mounted to the mounting base. The address previously programmed into the address identifier is read by the addressable device so that the device can be accessed from the remote controller through the system lines.

The present invention has distinct advantages over prior addressing approaches. As with approaches in which the address is provided on the mounting base, the present invention avoids the risk of changing an address when a detector is replaced or maintained. However, it presents significant additional advantages. The base can be in its simplest form because it serves no function other than to mount the addressable device. Further, the system is more reliable because the interface module need only be simple conductors to which reliable electrical connection may readily be made. In the prior mechanical approach, the mechanical communication through which the device sensed the address was subject to mechanical distortion, dissimilar material corrosion in sensing switches, breakage or loss of the address card. Further, the interface module allows the address to be set by an electrician during initial wiring of a building using readily available tools, with subsequent installation of the mounting base and detector by someone other than the electrician only after complete finishing of the ceiling and wall surfaces. The module is resistant to contamination such as dirt, paint and plaster during construction. Still further, by using common connectors for different types of devices, the addressing of the system can be made independent of the device type. For example, a common interface module may serve smoke detectors, heat detectors, alarm indicators, intrusion alarms, process control devices, thermostats, lighting control systems and other addressable devices.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF A PREFERRED EMBODIMENT

Figure 1:
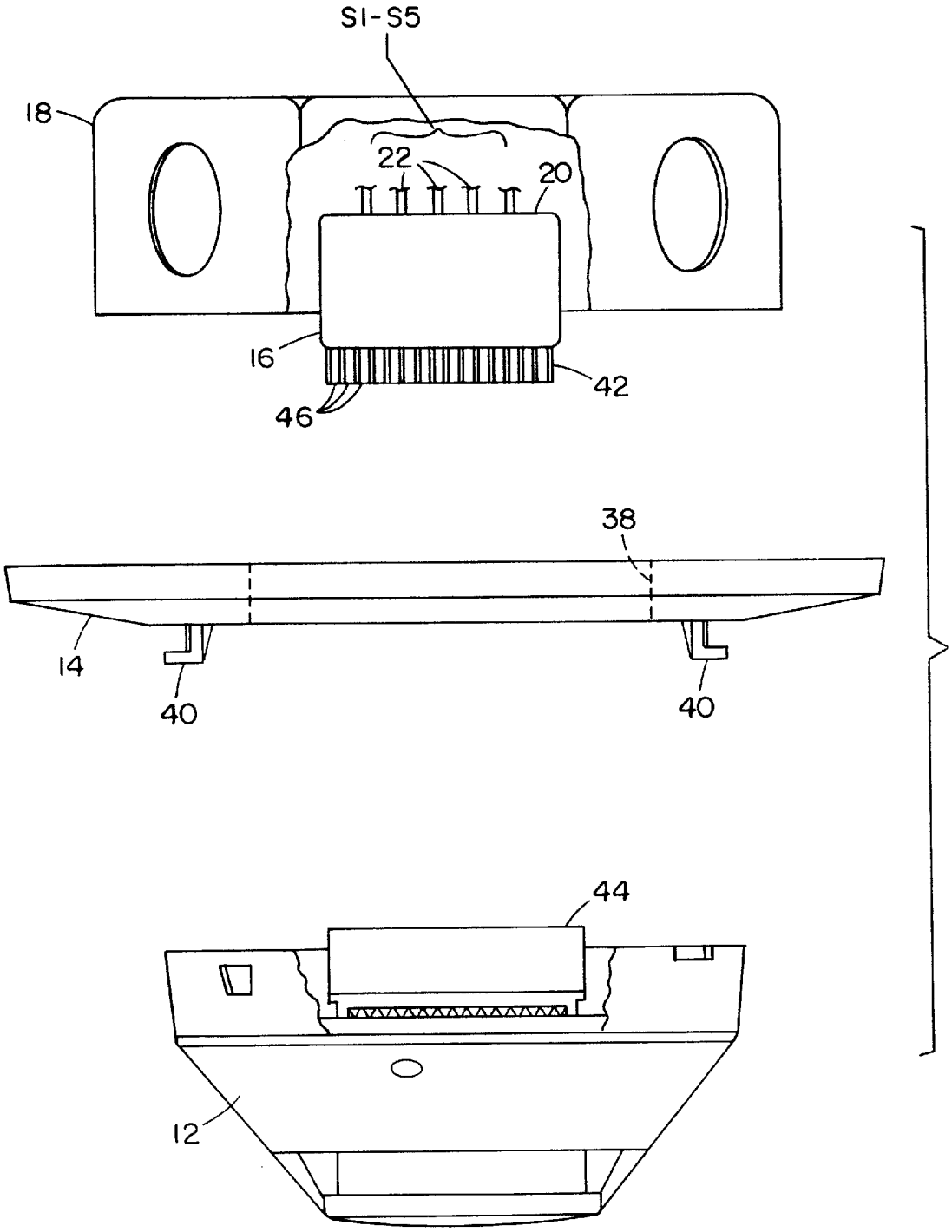
FIG. 1 is an exploded view of an addressable device assembly, including an interface module, associated with a conventional electrical box.

As illustrated in the exploded view of FIG. 1, an addressable device assembly of the present invention includes an addressable device such as a smoke detector 12, a mounting base 14, and an interface module 16. The assembly is mounted to a conventional electrical box which in this illustration is a ceiling mounted octagonal box 18. The module 16 serves as an interface between the detector 12 and wires 22 forming system lines S1–S5.

Figure 2:
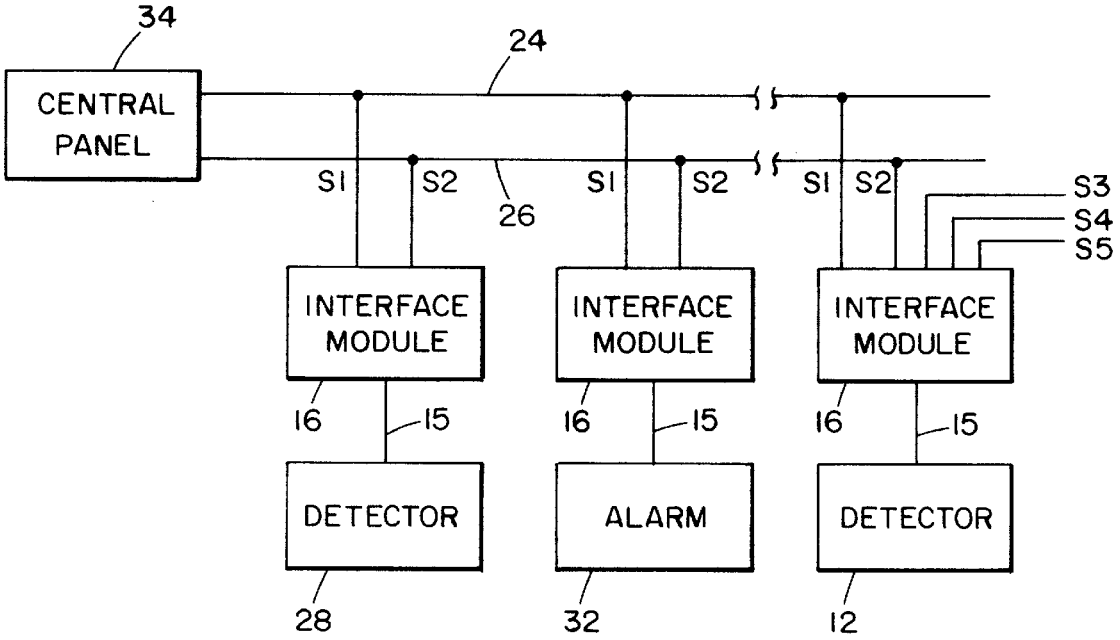
FIG. 2 is an electrical block diagram illustrating a system embodying the present invention.
Figure 3:
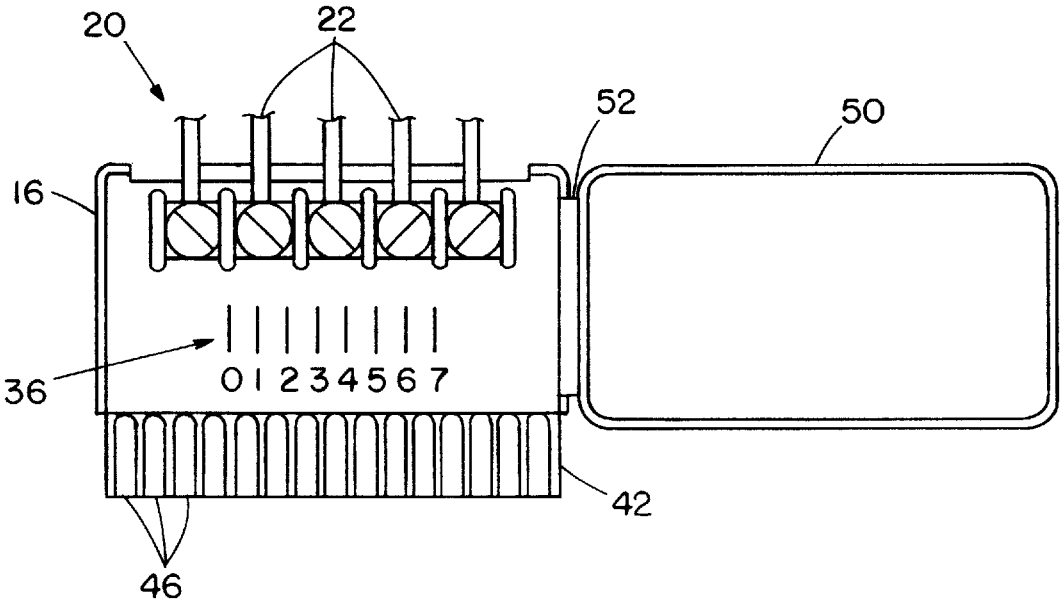
FIG. 3 illustrates the interface module opened for programming and electrical connection.

A preferred system to which the device assembly is connected is presented in U.S. Pat. No. 4,796,025 to Farley et al. and assigned to Simplex Time Recorder Company. In such a system, lines S1 and S2 connect each addressable device to a pair of network lines 24 and 26 as illustrated in FIG. 2. To that single pair of lines, a large number of addressable devices such as detectors 12 and 28 and alarm indicator 32 may be connected to and controlled by the central control panel 34. In this example, the additional three lines S3–S5 are remote drivers. In a specific implementation, S3 may be connected to a remote LED device to drive that device as a visual indication, and S4 and S5 drive remote relays. As an example, the remote relays may release fire doors. The lines S3–S5 are controlled by the electronics of the detector 12 in response to signals from the central panel over lines S1 and S2.

During the wiring process, an electrician opens a cover 50 which is hinged to the interface module 16 at a hinge 52. A system connector 20 and address identifier 36 are thereby exposed. In this case, the system connector 20 is a set of individual wire connectors to which the electrician connects the wires 22. The identifier 36 is preferably a set of jumper wires which protrude from the molded plastic module. These wires can be selectively disconnected by the electrician to set the address of the module and thus of the electrical box location. The conductors may be cut using commonly available tools such as diagonal cutters which are routinely carried by most electricians.

Figure 4:
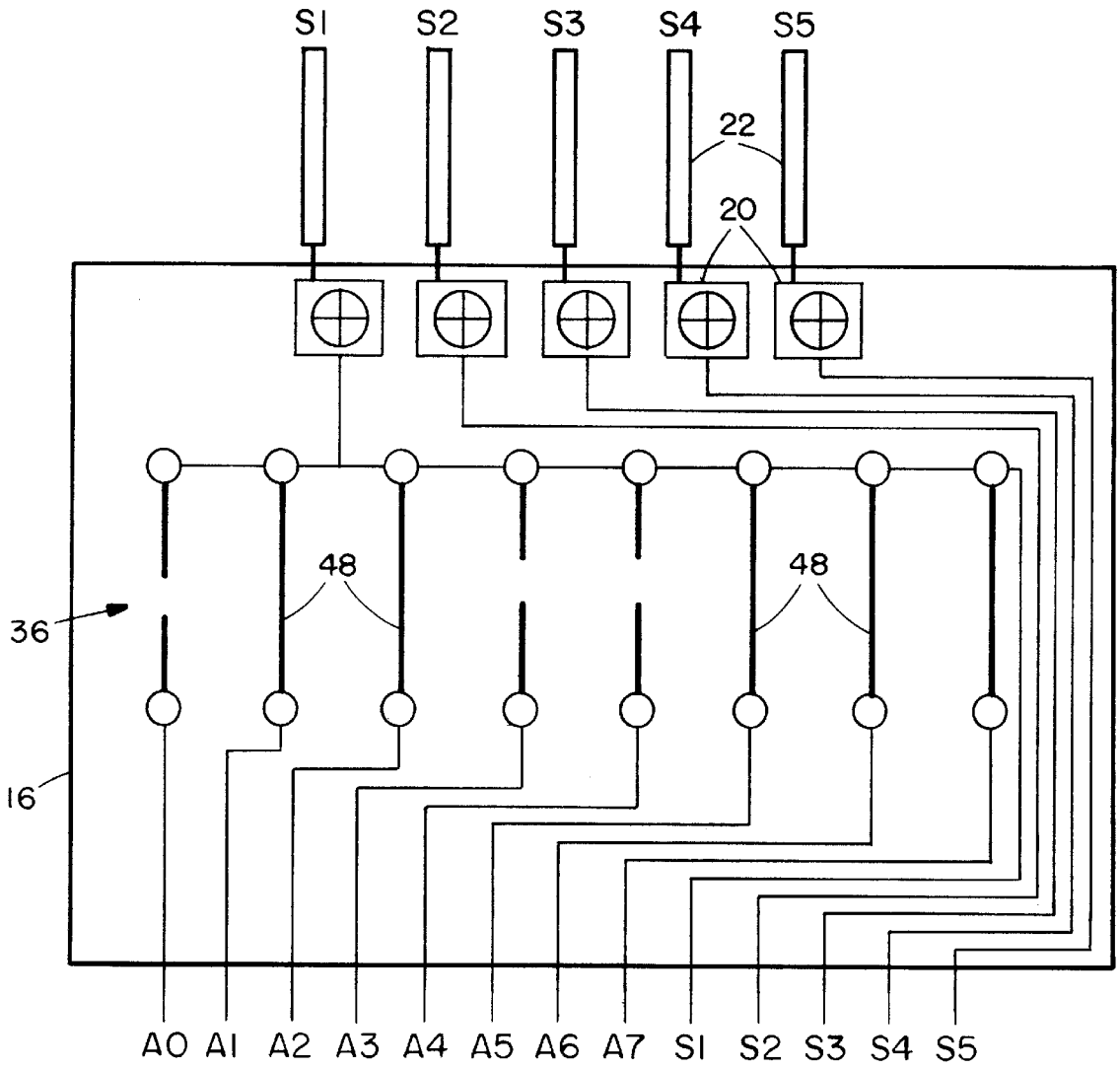
FIG. 4 is an electrical schematic of the interface module.

An electrical schematic of the interface module is presented in FIG. 4. As illustrated, jumper wires 48 for address bits A0, A3, and A4 have been clipped. Thus, the eight wires together identify an address such as 10011000. The jumper wires 48 are connected at one end in common and preferably to a system line S1. The opposite ends of the jumper wires are individually connected to the address contacts A0–A7 so that the individual states of the jumper wires can be interrogated by the detector electronics. The connectors 20 are also individually connected to signal lines S1–S5 in the device connector 50.

As an alternative, the conductors 36 may be replaced by a DIP switch. However, the use of jumper wires or other breakable conductors is generally preferred over a DIP switch because of the reduced cost, increased reliability and the permanence of the address. With that permanence it is less likely that an address will be inadvertently or maliciously changed. As yet another alternative, the jumper wires 48 could be replaced by zero ohm resistors which are more suitable for fabrication with automatic insertion equipment. Rather than breaking connections, the identifier could initially have sockets with no connections, connections being selectively made by adding conductors.

Once the wires 22 have been connected to the connector 20 and the conductors 36 have been appropriately clipped to identify an address, the cover 50 is again closed. The module 16 may remain suspended in the box 18 during completion of the building construction. Then, to install the addressable device, a mounting base 14 is mounted by a pair of screws to the electrical box 18. With the present invention, the mounting base 14 can be in its simplest form of only a plate having fingers 40, from which the detector 12 is later suspended, and an opening 38. The detector is installed by first connecting the interface module 16 and the addressable device 12 through complementary connectors 42 and 44. Through those connectors contact is provided from the addressable device to the eight address conductors 48 and to the five signal lines at the system connector 20. With that simple connection, electrical connection to the smoke detector 12 is complete. The detector can then be pressed against the base and rotated so that tabs therein mate with the fingers 40 to attach the detector.

In the illustration, the connectors are printed circuit board type connectors in which the device connector 42 on the module is a board which is inserted into the connector 44 on the addressable device. As illustrated, the circuit board connector 42 has 15 contact leads 46, 15 being a standard number of contacts, but any other number is possible. Also any other form of connectors, such as pin and socket connectors may be used.

Electronics in the detector 12 are powered directly from the positive and negative system lines S1 and S2 from the control panel. Thus activated, the electronics in the detector 12 read the state of the jumper wires to identify the address of the detector. Thereafter, the control panel may routinely interrogate the detector in accordance with the approach set forth in the above-mentioned Farley et al. patent.

While this invention has been particularly shown and described with references to preferred embodiments thereof, it will be understood by those skilled in the art that various changes in form and details may be made therein without departing from the spirit and scope of the invention as defined by the appended claims. For example, for a flat profile, the connector 44 on the addressable device may be oriented transversely relative to the device center axis so that the interface module can be positioned flush against the back of the device and slid into place. Or the contacts of connector 42 may extend from the rear surface of the module. The device connector need not be rigidly fixed to the module substrate. It may be coupled to the main body of the interface module through a short cable. Either connector may be a set of free wires extending from the module substrate. The system wires, for example, could then be connected with wire caps. The module is preferably of molded plastic, but it may be based on a small circuit board. The cover is a desirable option to protect the contacts on the interface module but is not a requirement.

What is claimed is:

1. A communication network comprising:

a system controller;

system lines connecting the system controller for communication with addressable devices;

interface modules associated with respective one of said addressable devices, each interface module comprising line connectors for connecting to the system lines and an electrically readable address identifier adapted to be programmed to an address with installation of the interface module;

said addressable devices, each connected to an interface module to connect to the system lines and to the electrically readable address identifier, each addressable device including electronics for reading an address from the readable address identifier and for responding to the controller with receipt of the address through the system lines; and mounting bases, each for mounting a respective one of said addressable devices over an electrical box and having an opening through which an interface module wired in the electrical box may pass for connection to said addressable device.

2. A system as claimed in claim 1 wherein the readable address identifier comprises breakable conductors.

3. A system as claimed in claim 1 wherein the readable address identifier comprises a set of switches.

4. A system as claimed in claim 1 wherein each interface module comprises a printed circuit board connector for connection to the addressable device and wire connectors for connecting to the system lines.

5. A system as claimed in claim 1 wherein the addressable device is a detector.

6. A system as claimed in claim 5 wherein the detector is a fire detector.

7. A system as claimed in claim 6 wherein the readable address identifier comprises breakable conductors.

8. A system as claimed in claim 7 wherein each interface module comprises a printed circuit board connector for connection to the addressable device and wire connectors for connecting the system lines.

9. An addressable device assembly comprising:

an interface module which includes a first connector and an electrically readable address identifier to be programmed to an address;

a mounting base for mounting an electronic device over an electrical box and having an opening through which the first connector wired in the electrical box may pass; and an addressable electronic device, the electronic device comprising a second connector for receiving the first connector through the mounting base opening to receive address lines and system signal lines prior to mounting to the mounting base, the electronic device including electronics for reading the device address from the readable address identifier through the address lines and for responding to a remote controller with receipt of the address through the system lines.

10. An addressable device as claimed in claim 9 wherein the addressable electronic device is a detector.

11. An addressable device assembly as claimed in claim 10 wherein the addressable electronic device is a fire detector.

12. An addressable device assembly as claimed in claim 9 wherein the readable address identifier comprises breakable conductors.

13. An addressable device assembly as claimed in claim 12 wherein the interface module comprises a printed circuit board and the first connector and second connector are printed circuit board connectors.

14. A method of addressing an addressable device connected to system lines comprising:

programming an address in an electrically readable address identifier in an interface module;

wiring the interface module to system wires leading into an electrical box;

mounting a mounting base over the electrical box;

connecting the addressable device to the programmed interface module to provide electrical connection from the addressable device to the readable address identifier and the system lines, and thereafter mounting the addressable device to the mounting base;

reading the address from the readable address identifier to the addressable device; and addressing the addressable device from a remote controller through the system lines using the address read from the readable address identifier.

15. A method as claimed in claim 14 wherein the readable address identifier comprises breakable conductors.

16. A method as claimed in claim 14 wherein the readable address identifier comprises a set of switches.

17. A method as claimed in claim 14 wherein the interface module comprises a printed circuit board connector for connection to the addressable device and wire connectors for receiving the system lines.

18. A method as claimed in claim 14 wherein the addressable device is a detector.

19. A method as claimed in claim 18 wherein the detector is a fire detector.

* * * * *